US009073282B2

(12) United States Patent
Wegele et al.

(10) Patent No.: US 9,073,282 B2
(45) **Date of Patent: *Jul. 7, 2015**

(54) PROCESS FOR CONTROLLING THE NIP FORCE/PRESSURE BETWEEN TWO ROTATING CYLINDERS

(71) Applicant: The Procter & Gamble Company, Cincinnati, OH (US)

(72) Inventors: George Vincent Wegele, Mason, OH (US); Frederick Edward Lockwood, Colerain Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 419 days.

This patent is subject to a terminal disclaimer.

(21) Appl. No.: 13/667,032

(22) Filed: Nov. 2, 2012

(65) Prior Publication Data

US 2014/0124608 A1 May 8, 2014

(51) Int. Cl.

| | |
|---|---|
| ***B65H 20/02*** | (2006.01) |
| ***B31F 1/07*** | (2006.01) |
| ***D21G 1/00*** | (2006.01) |

(52) U.S. Cl.

CPC *B31F 1/07* (2013.01); *B65H 20/02* (2013.01); *D21G 1/004* (2013.01); *B31F 2201/0753* (2013.01); *B31F 2201/0779* (2013.01)

(58) Field of Classification Search

CPC ..... B65H 20/02; D21G 1/004; B31F 1/07; B31F 2201/0753

See application file for complete search history.

(56) References Cited

U.S. PATENT DOCUMENTS

| | | | | |
|---|---|---|---|---|
| 5,379,652 | A | 1/1995 | Allonen | |
| 5,383,371 | A | 1/1995 | Laitinen | |
| 6,053,232 | A | 4/2000 | Biagiotti | |
| 6,109,326 | A | 8/2000 | Leakey et al. | |
| 6,325,323 | B1 | 12/2001 | Olsson | |
| 6,913,223 | B2 | 7/2005 | Heinonen | |
| 6,948,678 | B2 | 9/2005 | Acciari | |
| 7,018,475 | B2 | 3/2006 | Ueberschär et al. | |
| 2005/0156078 | A1 | 7/2005 | Ragard et al. | |
| 2006/0081179 | A1 * | 4/2006 | Ueberschar et al. | 118/663 |

FOREIGN PATENT DOCUMENTS

| | | |
|---|---|---|
| EP | 0642460 B1 | 9/1996 |

OTHER PUBLICATIONS

U.S. Appl. No. 13/667,045, filed Nov. 2, 2012, Wegele, et al.
PCT International Search Report, mailed Jan. 22, 2014, 72 pages.

* cited by examiner

*Primary Examiner* — William E Dondero
(74) *Attorney, Agent, or Firm* — Peter D. Meyer

(57) ABSTRACT

The present disclosure provides a process for monitoring and controlling the nip force between a fixed roll having a first longitudinal axis and a pivoting roll having a second longitudinal axis.

16 Claims, 4 Drawing Sheets

PROCESS FOR CONTROLLING THE NIP FORCE/PRESSURE BETWEEN TWO ROTATING CYLINDERS

FIELD OF THE INVENTION

The present disclosure generally relates to an apparatus for monitoring and controlling the nip force between two rotating cylinders. The present disclosure more particularly relates to an apparatus for regulating the force between two rotating rolls of an embossing process.

BACKGROUND OF THE INVENTION

Nips are typically employed at several stages in the manufacture of paper products such as bath tissue and paper toweling. In practice, a web material is passed through these nips to form the web material into the intended paper product. Examples of these nips may include dewatering presses located in paper machines, extended nips, calendaring nips, as well as the nips provided in the various winders. Nips are provided in these operations to provide desirable characteristics into the intended product. By way of non-limiting example, in a dewatering press, the transverse distribution (in the axial direction of the nip rolls) of the nip pressure affects the transverse moisture profile of the web to be pressed.

Another example to demonstrate the use of nips in a manufacturing operation is a nip associated with the reel-up process of a paper winding operation. Here, the process can begin with an empty spool or reel core that is brought into contacting engagement with a reeling cylinder—typically on a pair of rotating arms that terminate in forks that extend on either side of the reel core bearings. Once the paper reel has reached a given size, the roll spool is positioned between a pair of carriages which ride on level rails. Web tension is controlled by the reeling cylinder and torque is applied to the reel spool by a center wind assist. Nip load is controlled by hydraulic cylinders that position the carriages on which the bearing housings and thus the paper reel are supported. The hydraulic cylinders adjust the position of the paper reel to control the nip loading of the paper reel with the reeling cylinder. Nip pressure may be monitored by monitoring the pressure in the hydraulic cylinders which position the carriages.

In any regard, it should be understood that nips used in the consumer paper products industry commonly utilize a set of rolls (two or more) that are loaded to (i.e., pressed against) one another. Generally, it is desirable to load these rolls to one another at a set force. One of skill in the art will recognize this to be known generally as the nip force and is generally provided (or referenced) in terms of force per unit length. By convention herein, the units are known as pounds per linear inch (PLI or pli).

Generally, there are two methods to set the loading force between contacting cylinders. These techniques are known individually as "loading to pressure" and "loading to stops." The process of "loading to pressure" generally utilizes the force of lifting cylinders to go only to lifting a roll into place and then applying a load between the rolls. The process of loading to stops provides a lifting cylinder that provides a force to lift a pivoting roll. The applied lifting force presses the roll's bearing housings against a stop mechanism. The stop mechanism can be adjusted to control the amount of force seen between the contacting rolls.

More specifically, the process of loading to pressure can be simply described. In this method when the pivoting roll is commanded to load, hydraulic pressure is introduced into the load cylinder. The pressure introduced to the cylinder is set to provide a specific load, measured in PLI, between the two rolls the amount of pressure required is calculated via a free body diagram of the system and can be confirmed by measuring the nip width between the rolls. This is suitable when one or both rolls are rubber covered. In cases where both rollers are hard covered, a pressure sensitive film can be used to determine the nip force.

In these described prior art methods, problems have been encountered in the associated devices used for the measurement of nip forces relating to the calibration of the detectors in the transfer of the signal from the rotating roll. For example, the transfer of the signal can be accomplished through the use of glide rings and equivalent arrangements as well as telemetry equipment. However, these devices are complicated and susceptible to disturbance.

Thus, it would be advantageous to provide a novel device and method for measuring and controlling the nip forces and pressures between two rolls such as those used in an embossing process or a calendaring process. It would also be advantageous to provide a novel device and method to effectively distribute the nip forces and/or pressures between two rolls used in the manufacture of products such as consumer paper products. Along these lines it would also be advantageous to provide a measurement device and method that is suitable for on-line measurement of nip forces and/or nip pressures during production operation. It was also be advantageous to provide a device and method in which the problems related to the placement of detectors on a nip roll or nip band are minimized. Additionally, it would be advantageous to provide a device and method that provides for an easier and more accurate calibration of detectors than is currently known and available to those of skill in the art. It is envisioned that the drawbacks discussed above can be substantially avoided and the advantages realized by use of the process disclosed herein.

SUMMARY OF THE INVENTION

A non-limiting embodiment of the present disclosure provides a process for monitoring and controlling the nip force between a fixed roll having a first longitudinal axis and a pivoting roll having a second longitudinal axis. The process comprises the steps of: a) providing said fixed roll and said pivoting roll; b) providing said pivoting roll with a pivot axis said pivoting roll being pivotable thereabout; c) keeping said first longitudinal axis generally parallel to said pivot axis and said second longitudinal axis when said fixed roll and said pivoting roll are at least in proximate contacting engagement; d) providing a load cylinder for adjusting said second longitudinal axis relative to said first longitudinal axis, said load cylinder adjusting a position of said pivoting roll about said pivot axis; e) providing an adjustable stop disposed in a fixed relationship relative to said fixed roll; f) disposing a pressure sensing device upon said adjustable stop; g) providing a controller capable of adjusting said position of said adjustable stop relative to said pivoting roll; h) measuring a nip pressure exerted by said pivoting roll upon said adjustable stop with said pressure sensing device when said pivoting roll is in contacting engagement thereto; and i) adjusting said force disposed upon said adjustable stop in response to said pressure exerted by said pivoting roll upon said adjustable stop with said controller.

Another non-limiting embodiment of the present disclosure provides a process for monitoring and controlling the nip force between a fixed roll having a first longitudinal axis and a moveable roll having a second longitudinal axis. The process comprises the steps of: a) providing said fixed roll and said moveable roll; b) providing said first longitudinal axis generally parallel to said second longitudinal axis when said fixed roll and said moveable roll are at least in proximate contacting engagement; c) providing a load cylinder for adjusting said second longitudinal axis relative to said first longitudinal axis, said load cylinder adjusting a position of said moveable roll relative to said fixed roll; d) providing an adjustable stop disposed in a fixed relationship relative to said fixed roll; e) providing a pressure sensing device upon said adjustable stop; f) providing a controller capable of adjusting said position of said adjustable stop relative to said pivoting roll; g) measuring a pressure exerted by said moveable roll upon said adjustable stop with said pressure sending device when said moveable roll is in contacting engagement thereto; and h) adjusting said force disposed upon said adjustable stop in response to said pressure exerted by said pivoting roll upon said adjustable stop with said controller.

DETAILED DESCRIPTION

Figure 1:
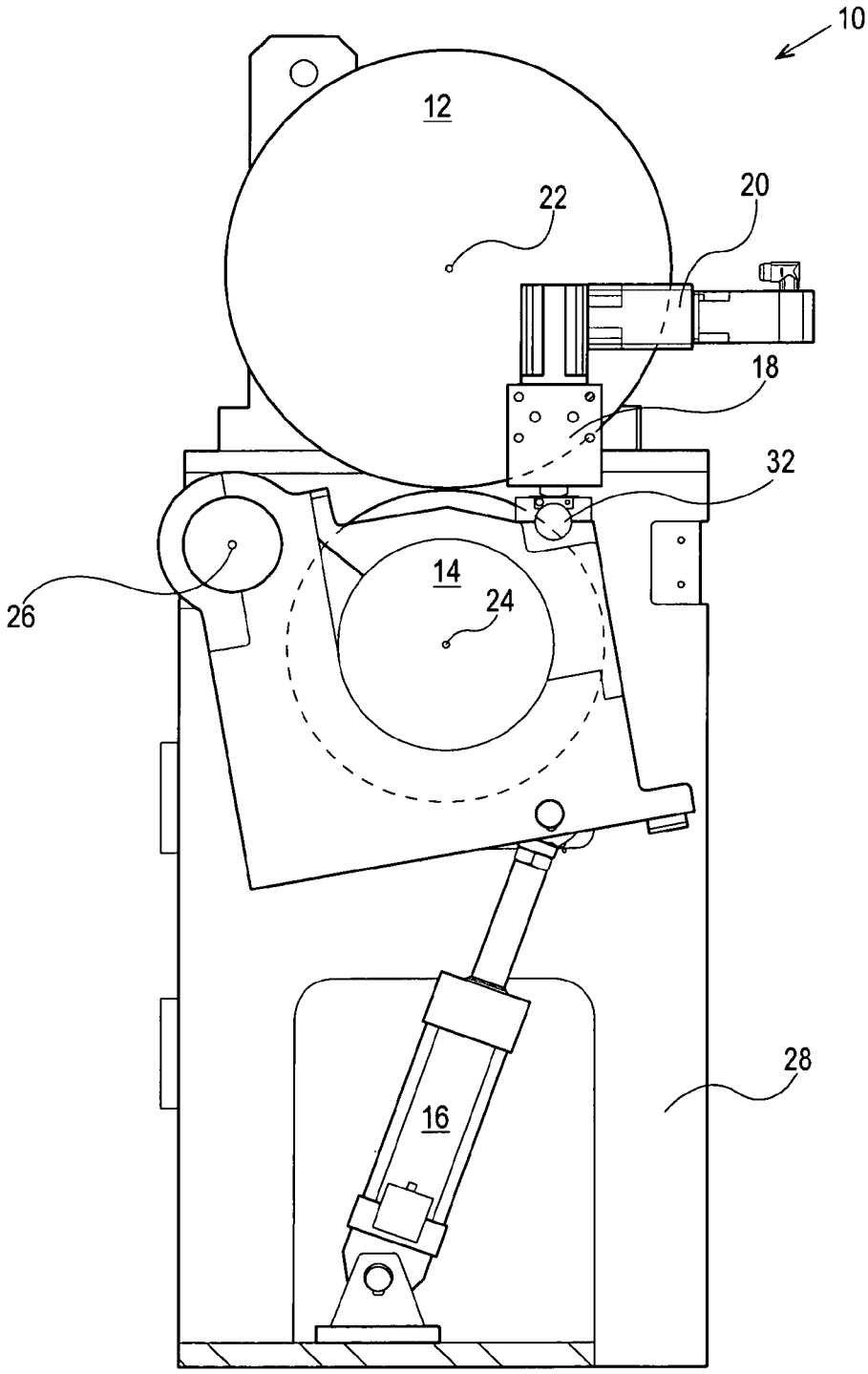
FIG. 1 is a cross-sectional view of an exemplary nip configuration that utilizes a loading to stops process between two opposed rolls one of which is provided with a roll cover in accordance with the present description.

As used herein, the term "machine direction" references the primary direction of travel of an object such as a web substrate though any manufacturing and/or processing equipment used to manufacture a paper product of the present invention. The "cross-machine direction" references the direction perpendicular and co-planar to the machine direction.

It should be understood by one of ordinary skill in the art that the present disclosure is a description of exemplary embodiments. The instant disclosure should not be intended as limiting in any respect. Broader aspects of the present disclosure are embodied in the exemplary constructions.

The apparatus and process of the present disclosure can be generally directed toward and useful in the production of a web substrate (such as a tissue product) having at least one surface provided with an embossing pattern on the surface thereof.

As used herein, the terms "tissue paper web," "paper web," "web," "paper sheet," and "paper product" are all used interchangeably to refer to sheets of paper made by a process comprising the steps of forming an aqueous papermaking furnish, depositing this furnish on a foraminous surface, such as a Fourdrinier wire, and removing the water from the furnish (e.g., by gravity or vacuum-assisted drainage), forming an embryonic web, transferring the embryonic web from the forming surface to a transfer surface traveling at a lower speed than the forming surface. The web is then transferred to a fabric upon which it is through air dried to a final dryness after which it is wound upon a reel.

To produce un-creped tissue paper webs, an embryonic web is transferred from the foraminous forming carrier upon which it is laid, to a slower moving, high fiber support transfer fabric carrier. The web is then transferred to a drying fabric upon which it is dried to a final dryness. Such webs can offer some advantages in surface smoothness compared to creped paper webs.

The tissue paper product of the present invention is preferably creped, i.e., produced on a papermaking machine culminating with a Yankee dryer to which a partially dried papermaking web is adhered and upon which it is dried and from which it is removed by the action of a flexible creping blade.

The terms "multi-layered tissue paper web," "multi-layered paper web," "multi-layered web," "multi-layered paper sheet," and "multi-layered paper product" are all used interchangeably in the art to refer to sheets of paper prepared from two or more layers of aqueous paper making furnish which are preferably comprised of different fiber types, the fibers typically being relatively long softwood and relatively short hardwood fibers as used in tissue paper making. The layers are preferably formed from the deposition of separate streams of dilute fiber slurries upon one or more endless foraminous surfaces. If the individual layers are initially formed on separate foraminous surfaces, the layers can be subsequently combined when wet to form a multi-layered tissue paper web.

A formed paper web may be processed after formation through a calendaring apparatus. This would be understood by one of skill in the art, a calendaring apparatus typically comprises a nip section for advancing a web material or sheet material that is formed by at least a pair of rollers. One roller is typically provided as a muscle roller and the other roller may be provided as a metal roller, a resilient roller, or a metal roller having a resilient cover disposed thereabout. The rollers are provided with a gap of equal spacing formed along the entire width of the roller face at the nip section of the rollers where the web substrate is to pass through. The gap is less than the thickness of the web substrate to be finished. Surface finishing of the web material is performed by advancing the web substrate through the gap.

In a typical calendaring apparatus, the gap is set from about 20% to about 80% of the thickness of the web substrate to be finished. Further one of skill in the art will likely understand that one of the rollers is preferably rotated at a higher circumferential speed (often ranging from about 20% to about 200% higher or more) than the other roller that rotates at a speed matching the speed of the web material. In certain calendaring operations one of the metal rollers of a calendar apparatus may be heated.

Similarly, a formed paper web may be processed after formation through an embossing system to provide a three-dimensional texture to the resulting structure. An exemplary embossing apparatus will comprise a pair of embossing rolls wherein each roll has an embossing pattern engraved on the peripheral surface of the roll. The rolls are inter-engaged with each other via their respective embossing patterns any certain radial depth of engagement. The inter-engaged rolls rotate in opposite directions and impart embossing patterns on both sides of a deformable web or sheet-type material passing between the rotating embossing rolls. The web or sheet-type material becomes deflected and deformed at the point of contact with protrusions of the inter-engaged embossing patterns of the rolls. The process essentially pushes the web or sheet-type material into recessions of the embossing patterns of the rolls. Upon disengagement of the protrusions and recessions the embossed material exits the embossing rolls and retains a certain degree of the imparted deformation as a desired embossing pattern.

In any regard, an embossing apparatus of the present disclosure may include a pair of rolls, such as a first embossing roll and second embossing roll. It should be realized that the apparatus could comprise a plurality of plates, cylinders, or other equipment suitable for embossing webs. In any regard, the exemplary embossing rolls are generally disposed adjacent to each other in order to provide a nip. The rolls are typically configured so as to be rotatable on an axis—the respective axes of the embossing rolls being generally parallel to one another. Each roll may be provided with a plurality of protrusions or embossing elements generally arranged in a pattern. The embossing rolls and the corresponding elements disposed upon the embossing rolls may be made out of any material suitable for the desired embossing process. This can include, without limitation, steel and other metals, ebonite, plastics, ceramic, and hard rubber, or any combination thereof.

By way of non-limiting example, a design element can be imparted to a fibrous structure comprises passing a fibrous structure through an embossing nip formed by at least one embossing roll comprising a design element such that the design element is imparted to the fibrous structure. Yet still, the resulting tissue webs from one or even a plurality of upstream process may require bonding in a super-posed elation to produce a laminated product. In any regard, the pressures and forces at the point of contact between adjacent and/or contacting rolls in any such system may need to be determined, set, and/or adjusted in order to maintain desired process requirements and/or the desired characteristics of the finally produced product.

One of skill in the art will understand that no matter the process and/or equipment, there may be several reasons why the nip force between the rolls of a calendaring or embossing operation may need to be changed. By way of non-limiting example, the requirements necessary to produce the product of choice may require different set points. Additionally, due to reasons of quality control, product deemed to be out of specification with current production needs may necessitate the need for changing the setting of the forces and/or pressures between the rolls.

Additionally, one of skill there will understand that various system configurations may require the need to change the forces and/or pressures between adjacent rolls. By way of example, in some calendaring or embossing operations, it is not uncommon to utilize rolls that are provided with rubberized and/or elastomeric covers. During operation, the rolls may be loaded against each other in a manner that compresses the rubberized and/or elastomeric cover. It is not difficult to envision that the compression of such a rubberized and/or elastomeric cover will cause the build-up of significant thermal gradients within and about the cover. These thermal gradients can cause the rubberized and/or elastomeric cover to expand, can cause the properties of the rubberized and/or elastomeric cover to change, or even cause the rubberized and/or elastomeric cover to prematurely age. It is also known to those of skill in the art that such rubberized and/or elastomeric roll covers typically harden with use over time. Because these rubberized and/or elastomeric roll covers are both expensive and require significant time to replace, it seems abundantly clear that a process that remedies the above-mentioned issues is required. In this light the description of the innovation presented herein in the accompanying figures is referenced.

Referring to FIG. 1, in its basic form, the apparatus 10 for monitoring and controlling the nip force between two opposing rolls of the present disclosure provides for a fixed roller 12 (or fixed roll 12), a pivoting roller 14 (or pivoting roll 14), a loading cylinder 16, an adjustable stop mechanism 18, and any necessary process controls 20.

The fixed roller 12 is a component that can provide a fixed datum. In other words, one of skill in the art will understand that the fixed roller 12 remains stationary relative to a surface 28. The fixed roller 12 can be any type of roller and provided with or without a cover as would be known to one of skill in the art. In a preferred embodiment, the fixed roller 12 is provided as a steel roll with no cover. However, one of skill in the art could provide the fixed roller 12 with protrusions and/or recessions so that fixed roller 12 is part of an embossing process. Further, one of skill in the art could provide the fixed roller 12 with an elastomeric cover.

Figure 2:
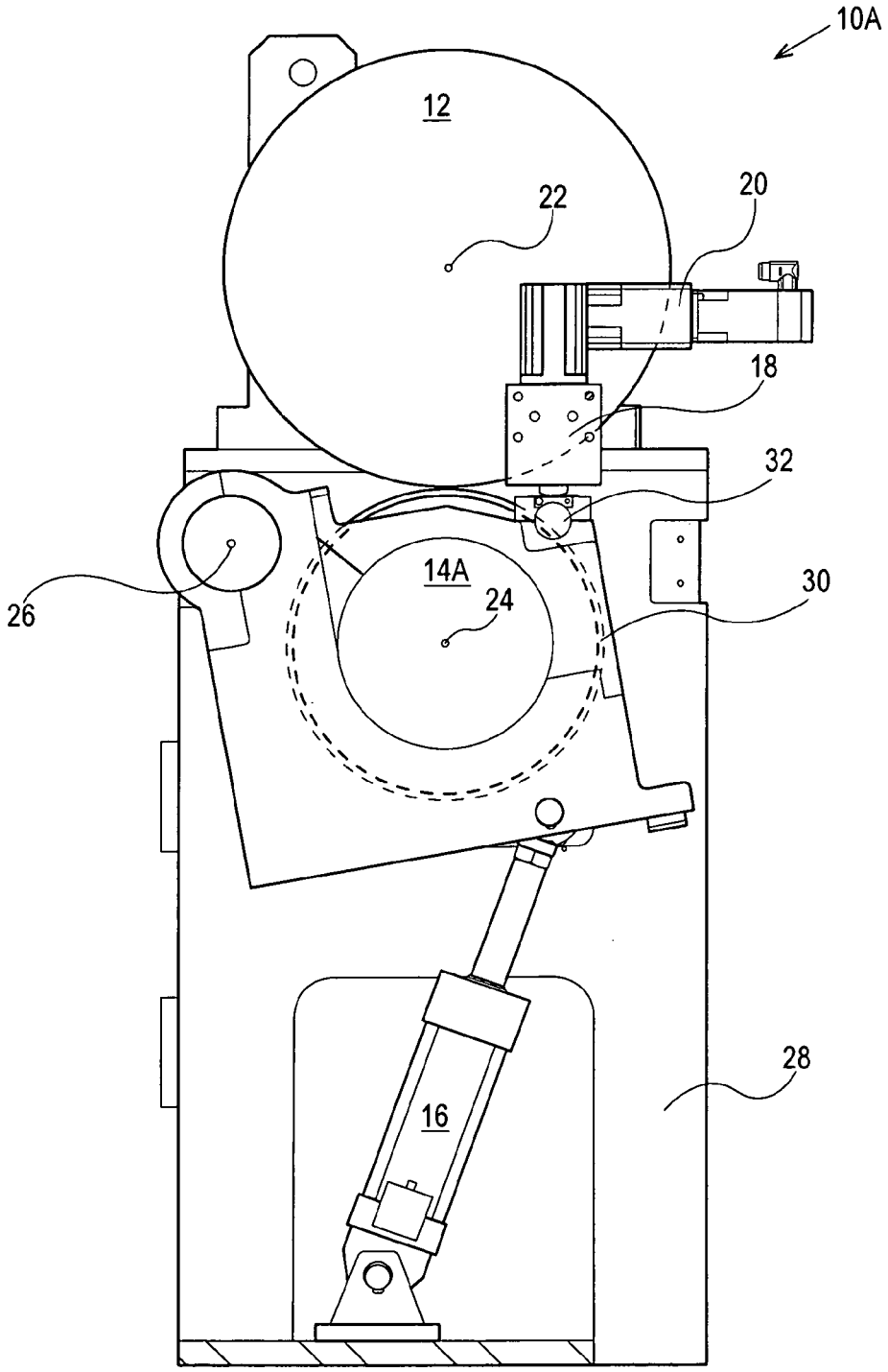
FIG. 2 is a cross-sectional view of another exemplary nip configuration that utilizes a loading to stops process between two opposed rolls both of which are not provided with roll covers.

The pivoting roller 14 can be provided as a component that is capable of pivotable motion about an axis 26 generally parallel to the axis of rotation 22 of the fixed roll 12. Similar to the fixed roller 12, the pivoting roller 14 is also provided with an axis of rotation 24 generally parallel to the axis of rotation 22 of the fixed roll 12. As would be known to one of skill in the art, the pivoting roller 14 can be provided with or without a cover 30. As shown in FIG. 1, a preferred embodiment the pivoting roller 14 is provided without an elastomeric (e.g., rubberized) cover 30. Alternatively, as shown in FIG. 2, a preferred embodiment the pivoting roller 14 is provided with an elastomeric (e.g., rubberized) cover 30.

As will also be recognized by one of skill in the art, in an alternative embodiment, the pivoting roller 14 can also be provided in a manner that provides motion relative to the fixed roller 12 so that the pivoting roller 14 is translated so that its axis of rotation 24 moves (i.e., translates) in a direction that is generally normal to a vector parallel to the axis of rotation 22 of the fixed roll 12 without the need for a pivot axis. In other words in a roller 14 suitable for use in a translation-based embodiment could utilize lift arms to move the position of roller 14 relative to fixed roll 12. For purposes of the present disclosure, and regardless of the manner of movement of roller 14 relative to fixed roll 12, the axis of rotation 24 of roller 14 should be generally translatable to the axis of rotation 22 of the fixed roll 12.

The loading cylinder 16 can be provided to provide the force required to move the pivoting roll 14 relative to the fixed roll 12. In other words, the loading cylinder 16 is capable of changing the position of the axis of rotation 24 of pivoting roller 14 relative to the axis of rotation 22 of the fixed roll 12. One of skill in the art will recognize that a suitable loading cylinder 16 can provide the force necessary for this movement hydraulically, pneumatically, electrically, magnetically or in any other manner consistent with the scope of the present disclosure. An exemplary hydraulic cylinder suitable for use as loading cylinder 16 is manufactured by Parker Hannifin Corporation. A suitable hydraulic cylinder for loading cylinder 16 is Parker part number 4.00SB2HXLTS19AX8.00; S=integral connector D6 feedback code: NNNW2N 0_10V output. Preferably, the position sensor within loading cylinder 16 is a magnetostrictive wave guide position feedback sensor. A suitable electronic pressure regulator for loading cylinder 16 can be obtained from Sun Hydraulics Corporation as part number RBAP-LBN-2C24V.

The adjustable stop mechanism 18 is provided to control the distance disposed between the axis of rotation of the fixed roll 22 and the axis of rotation of the pivoting roll 24. It was found that this can allow control of the amount of force observed and/or applied between the fixed roll 12 and pivoting roll 14.

In a preferred embodiment, the force generated by the loading cylinder 16 would preferably range between about 1000 lbf and about 25000 lbf or between about 4000 lbf and about 15000 lbf. In a preferred embodiment, the force observed between fixed roll 12 and pivoting roll 14 would preferably range between about 10 pli and about 300 pli or between about 50 pli and about 200 pli. In a preferred embodiment, the force observed by adjustable stop mechanism 18 would preferably range between 0 lbf and about 30000 lbf or between about 500 lbf and about 10000 lbf.

As provided herein, a suitable exemplary load cell 32 can be provided as a load sensing device such as a strain gauge, piezoelectric transducer, pressure sensor, occlusion sensor, flow sensor, force sensor, scale, miniature load cell, low capacity load cell, liquid level sensor, float switch, pressure transducer, and the like. However one of skill in the art will recognize that any form of load cell 32 that is capable of realizing and responding to the amount of force applied to the adjustable stop mechanism 18 is suitable for use with the apparatus 10 of the present disclosure. A suitable load cell 32 can be obtained from Strainsert, Inc. and is available as load cell CPA-1.5 (SS) X. A pressure transducer suitable for use with the present apparatus 10 can be obtained from TURCK, Inc. as part number PT2000PSIG-13-LU2-H1131.

In the case where it is preferable to automate the control systems for the current apparatus 10, it may be preferable to provide process controls 20 that are servo-driven. In an instance where the adjustable stop mechanism 18 is provided as indicated herein, any adjustments to apparatus 10 through the process controls 20 can be made through the use of an operator interface. In instances where instrumentation may exist to determine loading cylinder 16 pressures and the resulting forces applied to the adjustable stop mechanism 18 as measured by the load cell 32, any required adjustments to be made without the need for stopping the apparatus 10 thereby jeopardizing any production needs and/or goals. This is primarily due to the removal of any need to verify any applied load forces and/or pressures at the nip formed between fixed roll 12 and adjustable roll 14.

It should be generally recognized that the process controls 20 detailed herein can generally relate to equipment that control and monitor the overall apparatus 10 function and performance. Such process controls 20 are generally not considered to be part of the mechanical assembly of the apparatus 10. In other words, the process controls 20 can be provided through a computer-related interface such as a human machine interface (HMI) or as a manually adjustable device such as a turn screw, lever, caliper, or the like. An exemplary process control 20 suitable for use with the apparatus 10 of the present disclosure can comprise pressure transducers and controllable pressure regulators operatively connected to any hydraulic control circuitry. An exemplary servo-actuated nip adjuster assembly contains: 1) Danaher Micromotion; DTR090-500-0-RM090-20 500:1 right angle reducing gearbox and; 2) Allen Bradley; MPL-B230P-VJ42AA servo motor.

Embodiments of the apparatus 10 disclosed herein can utilize computer program products, systems, and methods for using the apparatus 10 in the context of a manufacturing process. Generally, the embodiments described herein may utilize a calculation routine (algorithm) that utilizes programmable logic controller code used by a programmable logic controller provided as a component of the machine to control various actuators of the machine. As used herein, the phrase "programmable logic controller" encompasses traditional programmable logic controllers as well as microcontrollers, application specific integrated circuits (ASIC), and the like, that may be utilized in embedded systems. Further, the phrase "programmable logic controller code" as used herein means program code that is executed by a programmable logic controller, microcontroller, ASIC, or the like. The calculation routine may use geometric information regarding the various mechanical elements of the machine (e.g., rolls, actuators, stops, loading cylinder, etc.) and actuators (e.g., servo motors, pneumatic cylinders, hydraulic cylinders, linear actuators, etc.) to produce output response data, such as servo drive positioning tables, for example.

It should be recognized by one of skill in the art, that the embodiments may be used in conjunction with a computer device as well as a human machine interface for use with apparatus 10. For example, an operator of a machine may switch between the actual human machine interface used to control the machine and a graphical user interface. It should be understood that the components discussed herein are merely exemplary and are not intended to limit the scope of this disclosure. More specifically, while the components are discussed as residing within a computer device or the human machine interface, this is a non-limiting example. In some embodiments, one or more of the components may reside external to the computer device or the human machine interface. For example, a control device may be directly linked to the apparatus 10 or indirectly linked to the apparatus 10 by use of peripheral control devices or communications ports such as through the world-wide web (WWW).

Commensurate in scope with the present disclosure, an exemplary embodiment of the apparatus and process for controlling the nip force between rotating cylinders is provided infra.

In the consumer paper products industry one of skill in the art will understand that it is common to have a set of rolls (e.g., two or more) that are loaded (i.e., compressed) against one another. In most circumstances it is desirable that these opposed rolls be loaded to one another at a set force. This set force is known to those of skill in the art as the nip force. As mentioned previously, the nip force is typically provided in terms of force per unit length.

Relative to the present disclosure, the pivoting roll 14 is preferably positioned relative to the fixed roll 12 so that the axis of rotation of the pivoting roll 24 is brought closer to the axis of rotation of the fixed roll 22. This would be understood by one of skill in the art to be the condition of loading the pivoting roll 14 against the fixed roll 12. When the pivoting roll 14 is loaded against the fixed roll 22, hydraulic pressure is introduced into the load cylinder 16. The pressure introduced into the load cylinder 16 is set so that the force generated between the fixed roll 12 and the pivoting roll 14 is sufficient to provide the desired loading between the respective rolls. This force generated between the fixed roll 12 and the pivoting roll 14 should also provide a desired amount of force against the roll stop 18. The amount of force (or pressure) required between the fixed roll 12 and pivoting roll 14 can be determined (e.g., calculated) with the use of a free body diagram of the system. An exemplary free body diagram of the system is provided in FIG. 3.

Figure 3:
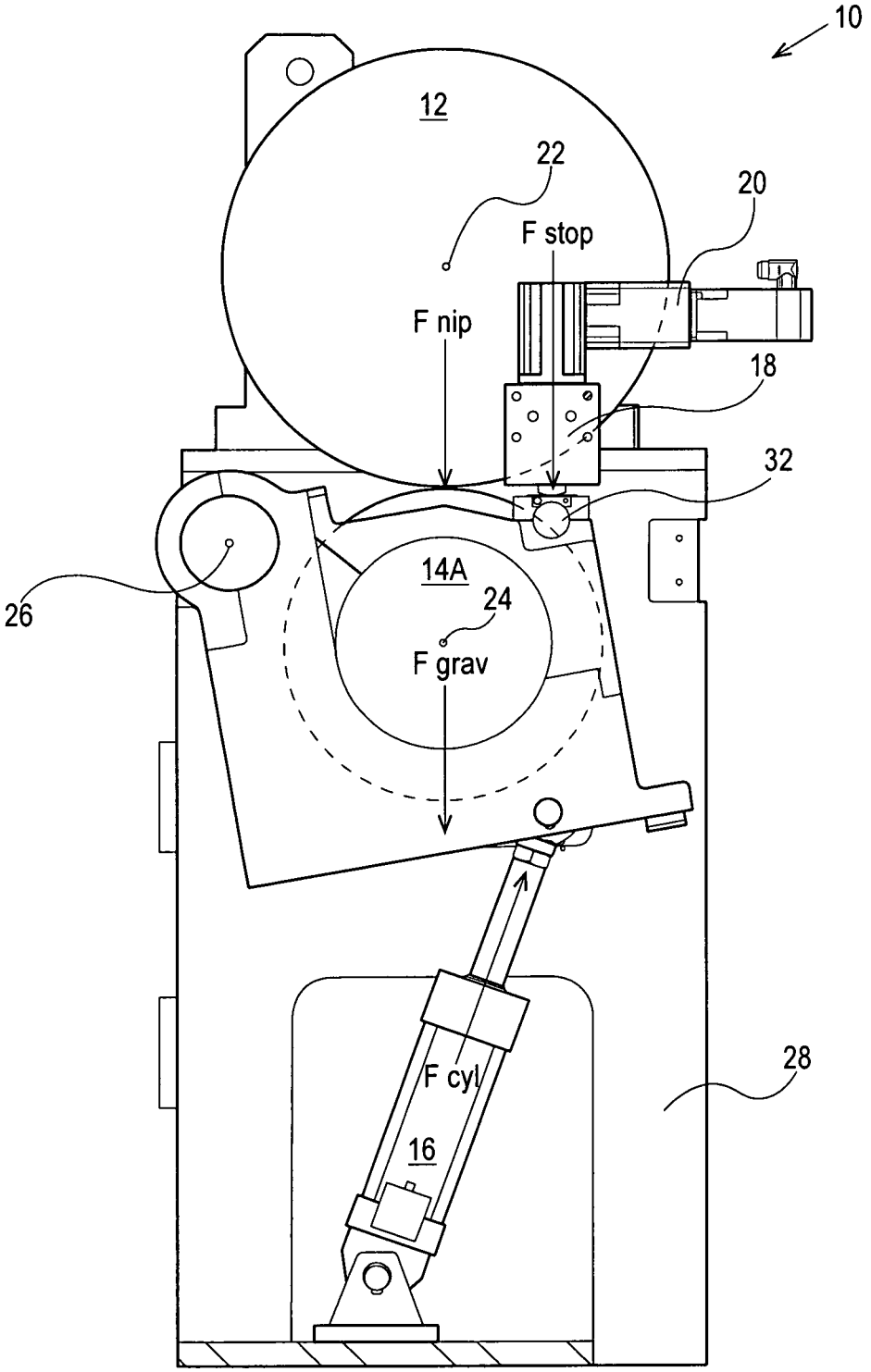
FIG. 3 is a cross-sectional view of the exemplary nip configuration of FIG. 2 showing the various forces of the components of the exemplary loading to stops process of the present description; and, FIG. 4 is an exemplary flow chart detailing the process for monitoring and controlling the nip force between two rotating cylinders as provided within the present disclosure.

As shown in FIG. 3, the free body diagram as illustrated provides for an indication of the respective considerations likely necessary to calculate a desired force to be applied between the fixed roll 12 and pivoting roll 14. This can include the nip force ($F_{NIP}$), the force applied to the stop ($F_{STOP}$), the force due to gravity exerted upon the pivoting roll 14 ($F_{GRAV}$), and the force applied by the load cylinder 16 to the pivoting roll 14 ($F_{CYL}$).

Returning again to FIGS. 1-2, the roll stop 18 is adjustable in order to provide the ability to transfer any portion of the load applied by pivoting roll 14 upon fixed roll 12 to roll stop 18. One of skill in the art will recognize that process controls 20 can be programmed to include an error correction algorithm compare the actual applied load applied by pivoting roll 14 roll stop 18 to a desired load applied by pivoting roll 14 roll stop 18. In other words, the roll stop 18 preferably is adjusted to shift more applied load to or from the roll stop 18 to attain the desired loading (in PLI) between the fixed roll 12 and pivoting roll 14. The actual loading between the fixed roll 12 and pivoting roll 14 can be confirmed by measuring the nip width between the fixed roll 12 and pivoting roll 14 when either pivoting roll 14 is provided with a roll cover 30, fixed roll 12 is provided with a roll cover, or both fixed roll 12 and pivoting roll 14 are provided with respective roll covers. In the event neither fixed roll 12 nor pivoting roll 14 is provided with a roll cover (i.e., both fixed roll 12 and pivoting roll 14 are formed from steel or other hard material or fixed roll 12 and/or pivoting roll 14 are provided with a non-elastomeric covering), a pressure sensitive film or pressure sensitive cover 30 can be applied to one or both rolls to determine the force or pressure at the nip formed between fixed roll 12 and pivoting roll 14.

Without desiring to be bound by theory is been found that the apparatus 10 and process of the present disclosure is preferable as any binding in the apparatus 10 or any irregularities that may be present on either surface of fixed roll 12 or pivoting roll 14 can be overcome. This is believed to be true because the loading force provided by the fixed roll 12 and pivoting roll 14 is higher than what is needed for roll loading requirements and can act to maintain the necessary distance between the axis of rotation 22 of fixed roll 12 and the axis of rotation 24 of pivoting roll 14 to provide the force needed.

In order to calculate roll loading and since this apparatus and method are designed to load two stops, the ensuing discussion is limited to this particular apparatus and process. Although one of skill in art will understand that the pressure loading method can be derived from the stop loading method by setting the $F_{STOP}=0$.

One of skill in the art will understand that it can be assumed that when doing the analysis of any that a free body diagram can be constructed and can be utilized to provide the information necessary for any physical calculation. Such information may include, for example, component weights, distances between components, and angles of force projection. Here, for example, one can sum the moments about the pivot point of the pivoting roll 14 or any other convenient reference. Presuming that the system possesses no angular acceleration, the sum of the moments should be equal to zero.

As a matter of reference, the moment arms and angles in a fine discussion will be given the same subscript as or associated forces. That being said, the vector equation takes the form:

$$\sum_{i}^{n} M_i = 2 * M_{CYL} + 2 * M_{STOP} + M_{NIP} + M_{GRAV} = 0$$

this equation will be recognized by one of skill in the art as the "sum of the moments" where $M_i=F_i$ X d, where $F_i$ is the force and $d_i$ is the vector distance between the pivot point or whatever point the moments are to be summed about and the acting point of the force. "X" is the vector cross product between the associated force and vector (3-dimensional) distance. Therefore the moment equation contains eight terms with one unknown. Of these eight variables, all four distances are known as they can be determined geometrically by one of skill in the art. The force due to gravity ($F_{GRAV}$) in the free body diagram represents the weight of the assembly (here pivoting roller 14) being moved. $F_{CYL}$, the force exerted by the loading cylinder 16, can be determined via pressure transducers positioned within the apparatus 10. Alternatively, this value can be obtained manually using a pressure indicator on the load side of the hydraulic circuit. $F_{STOP}$, the force on the roll stop 18, can be determined with the use of the load cell(s) intimately mounted in the roll stop 18. Therefore the remaining term in the equation, $F_{NIP}$, can be resolved using the above equation.

Thus the pressure per unit length (in PLI) can be given by the following equation:

$$\text{Pressure per Unit length } (PLI) = \frac{F_{NIP}}{\text{Roll Length}}.$$

Therefore, having the ability to determine the cylinder force and the stop force allows one to set up close using the roll stop 18. Of course this provides that one of skill in the art understands that the instrumentation mentioned above is present in the apparatus 10.

Figure 4:
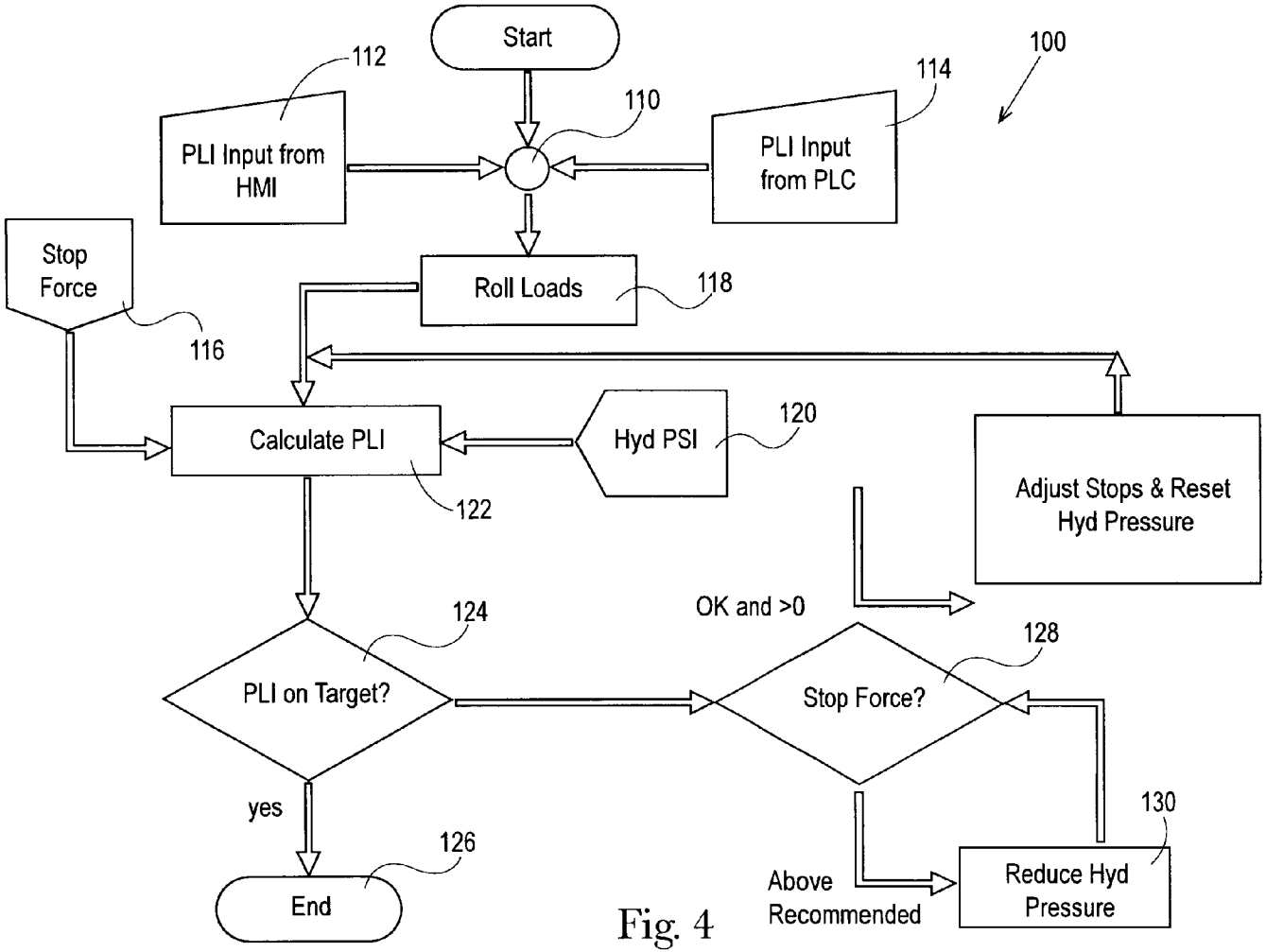

The process 100 for controlling the nip force and/or pressure between two rolls of the apparatus 10 disclosed herein can be described as follows while referencing the flowchart provided in FIG. 4.

As seen in the accompanying flowchart, the process 100 of the present disclosure provides for a set point 110 to be either set from a human machine interface (HMI) 112 or from a programmable logic controller (PLC) 114. These set-points can be determined based upon product requirements (e.g., product centerlines) or any other criteria necessary to provide the desired final product. The initial nip force set-point 116 is also provided to the process 100 so that a calculation of the necessary force and/or pressure to be applied by the pivoting roll 14 against fixed roll 12 can be applied to pivoting roll 14 by loading cylinder 16.

The process 100 facilitates an initial roll loading process 118 and data from the roll loading process 118, the initial stop force set-point 116, as well as the initial hydraulic pressure 120 applied to loading cylinder 16 are utilized to calculate initial loading force and/or pressure 122 between fixed roll 12 and pivoting roll 14. It should be recognized that in the machine centerlines for the initial hydraulic pressure 120 provided to the apparatus 10 of the present disclosure are provided from an embedded PLC and are typically not operator accessible.

As the rolls 12, 14 are loaded 118 (or commanded to load) they are preferably loaded to the calculated PLI 122 as determined according to the process discussed supra. An exemplary calculation for determining the calculated PLI 122 is provided in the description of the apparatus 10.

The actual force and/or pressure between the loaded rolls 12, 14 is then measured and compared to the calculated force and/or pressure between the loaded rolls 12, 14 to determine if the force and/or pressure is at or near the target force and/or pressure 124. This determination can then be used to adjust the roll stop 18 force and/or pressure 116, the roll 12, 14 loading force and/or pressure 118, and/or the applied hydraulic pressure 120 as may be required by the system. If the target force and pressure 124 is within the desired range of acceptable forces and/or pressures, then the process 100 can be terminated 126. In this instance, the process 100 can be restarted in order to ascertain whether or not the actual applied force and/or pressure required by the apparatus 10 is within the desired range of acceptable forces and/or pressures as may be required.

If the target force and/or pressure is not within the desired range of acceptable forces and/or pressures, the process 100 can then determine the roll stop 18 force and/or pressure 128. If it is determined that the roll stop 18 force and/or pressure 116 is too high then it may be appropriate to reduce the applied hydraulic pressure 130 applied by load cylinder 16 in order to bring the roll stop 18 force and/or pressure 116 into the desired range of acceptable forces and/or pressures. An appropriate pressure transducer suitable for use for sensing the applied hydraulic pressure to load cylinder 16 can be obtained from TURCK, Inc. as part number PT2000PSIG-13-LU2-H1131. The pressure transducer can close the feedback loop for the overall control of the pressure exerted upon roll stop 18 which affects the overall pressure at the nip formed between fixed roll 12 and pivoting roll 14. A suitable electronic pressure regulator for loading cylinder 16 can be obtained from Sun Hydraulics Corporation as part number RBAP-LBN-2C24V.

Without desiring to be bound by theory, it is believed that reducing the applied hydraulic pressure 130 applied by load cylinder 16 can facilitate the use of equipment that is provided with a lower design attribute. This may include for example the use of motors having lower capacity ratings and gearboxes with a lower design operation.

When it has been determined by the process 100 and acceptable roll stop 18 force and/or pressure 116 has been achieved it would be understood by one of skill in the art that the process controls 20 of the apparatus 10 can translate the location and/or the position (i.e., adjust) of roll stop 18 as may be required by the process 100. As would be understood the process 100 can then be repeated any number of times or as often as required by the process 100 in order to ensure that apparatus 10 is functioning in a manner consistent with the desired production of the final end product.

It would be realized by one of skill in the art that benefits of the use of apparatus 10 and process 100 of the present disclosure can provide significant improvements over currently known systems. First, it should be understood that with the use of roll covers upon either of fixed roll 12 and/or pivoting 14, during operation this roll cover will undergo thermal changes. As mentioned supra, is believed that with increasing use, the temperature change experienced by a roll cover will increase significantly. Thus, the properties of the roll cover change as well as the effective diameter of the roll cover. It would be readily recognized that either of these effects will likely alter the loading between the fixed roll 12 and pivoting roll 14.

Second, one of skill in the art will appreciate that current systems and/or processes that require any equipment in such a situation to be stopped and the machine operators take measurements of the nip force between two opposed rollers.

Third, one of skill in the art will appreciate that some systems require the operator (human and/or computer) to cease machine operations once it has reached operating temperature and then manually measuring the nip width. Such measurements are typically provided by using for example carbon paper impressions. This is costly and frankly inefficient.

The presently described apparatus 10 and process 100 and can provide the capability to automatically compensate for changes to the roll cover (if used) as it interacts with the other roll. In other words, operators utilizing the apparatus 10 and/or process 100 of the present disclosure will be able to monitor any changes in nip force and/or pressure as a function of both machine speed and temperature (e.g., the visco-elastic properties of the roll cover). Thus an operator would be advised (human and/or computer) that the roll stop 18 requires adjustments in order to compensate for any detected change in operating conditions. It should be readily appreciated that this can reduce the amount of downtime typically associated with adjustment of the nips formed between fixed roll 12 and pivoting roll 14 on a manufacturing line that has undergone temperature changes. Additionally, it would be understood that since the applied force and/or pressure between the fixed roll 12 and pivoting roll 14 cannot be held at a more constant value, any product produced from the apparatus 10 will likely exhibit more uniform characteristics.

Fourth, it would be realized by one of skill in the art that a manufacturing system utilizing the apparatus 10 described herein could likely be used to produce a variety of end products. It is also highly likely that the centerlines associated with each of the variety of end products are different. Thus, another benefit of the apparatus 10 and process 100 described herein can provide for the rapid changeover from one product to the next without or with limited operator interaction. This can provide a reduction in downtime between differing product runs and likely provide more repeatable desired characteristics displayed in the end products.

Fifth, it would be realized by one of skill in the art that a manufacturing system utilizing the apparatus 10 and process 100 described herein can facilitate initial setup of the fixed roll 12 and pivoting roll 14 when the fixed roll 12 and pivoting roll 14 of the apparatus 10 are changed due to the need for differing and products or when the fixed roll 12 and/or pivoting roll 14 have reached the end of their useful life. This can also provide a reduction in downtime—an integral concern of modern manufacturing system, as well as providing any desired characteristics displayed in the end products in a more repeatable fashion.

Finally, use of the apparatus 10 and process 100 described herein can also be easily adapted to function in the previously described pressure control mode. Without desiring to be bound by theory, it is believed that the apparatus 10 can simply be commanded to remove the presence of the stop 18 (i.e., the so-called "backing out" of the stop 18). This can then back of the stop 18 out until no force and/or pressure is experienced by the stop 18.

The dimensions and/or values disclosed herein are not to be understood as being strictly limited to the exact numerical dimension and/or values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for controlling the nip pressure between a fixed roll having a first longitudinal axis and a pivoting roll having a second longitudinal axis, said process comprising the steps of:

providing said fixed roll and said pivoting roll;

providing said pivoting roll with a pivot axis, said pivoting roll being pivotable thereabout;

keeping said first longitudinal axis generally parallel to said pivot axis and said second longitudinal axis when said fixed roll and said pivoting roll are at least in proximate contacting engagement;

providing a load cylinder for adjusting said second longitudinal axis relative to said first longitudinal axis, said load cylinder adjusting, a position of said pivoting roll about said pivot axis;

providing an adjustable stop disposed in a fixed relationship relative to said fixed roll;

disposing a first force sensing device upon said adjustable stop;

disposing a second force sensing device between said fixed roll and said pivoting roll;

providing a controller capable of adjusting said position of said adjustable stop relative to said pivoting roll;

measuring a force exerted by said pivoting roll upon said adjustable stop with said first force sensing device when said pivoting roll is in contacting engagement thereto;

measuring a force exerted by said pivoting roll upon said fixed roll with said second force sensing device when said pivoting roll is in contacting engagement thereto; and, adjusting said force disposed upon said adjustable stop in response to said force exerted by said pivoting roll upon said adjustable stop and said force exerted by said pivoting roll upon said fixed roll with said controller.

2. The process of claim 1 further comprising the step of providing a mechanism for adjusting a position of said adjustable stop relative to said pivoting roll.

3. The process of claim 2 further comprising the step of providing said mechanism with an algorithm for adjusting said position of said adjustable stop relative to said pivoting roll.

4. The process of claim 3 further comprising the step of said algorithm causing said controller to maintain a desired fierce between said fixed roll and said pivoting roll based upon input provided by said first force sensing device to said controller.

5. The process of claim 2 further comprising the step of controlling said apparatus with a programmable logic controller, said algorithm residing in said programmable logic controller.

6. The process of claim 5 further comprising the step of providing said algorithm as responsive to said force exerted by said pivoting roll upon said adjustable stop and said force exerted by said pivoting roll upon said fixed roll.

7. The process of claim 1 further comprising the step of adjusting said pivoting roll relative to said fixed roll.

8. The process of claim 1 further comprising the step of disposing an elastomeric cover about a surface of said pivoting roll.

9. The process of claim 1 further comprising, the step of providing said first longitudinal axis parallel to said second longitudinal axis when said fixed roll and said pivoting roll are in contacting engagement.

10. A process for controlling the nip force between a fixed roll having a first longitudinal axis and a moveable roll having a second longitudinal axis, said process comprising the steps of:

providing said fixed roll and said moveable roll;

providing said first longitudinal axis generally parallel to said second longitudinal axis when said fixed roll and said moveable roll are at least in proximate contacting engagement;

providing a load cylinder for adjusting said second longitudinal axis relative to said first longitudinal axis, said load cylinder adjusting a position of said moveable roll relative to said fixed roll;

providing an adjustable stop disposed in a fixed relationship relative to said fixed roll;

providing a force sensing device upon said adjustable stop;

providing a second force sensing device between the fixed roll and the moveable roll;

providing a controller capable of adjusting, said position of said adjustable stop relative to said moveable roll;

measuring a force exerted by said moveable roll upon said adjustable stop with said force sensing device when said moveable roll is in contacting engagement thereto; measuring a force exerted by the moving roll upon the fixed roll with said second force sensing device when said moveable roll is in contacting engagement thereto; and, adjusting said force disposed upon said adjustable stop in response to said force exerted by said moveable roll upon said adjustable stop and said force exerted by said moveable roll upon the fixed roll with said controller.

11. The process of claim 10 further comprising the step of providing a mechanism for adjusting a position of said adjustable stop relative to said moveable roll.

12. The process of claim 11 further comprising the step of providing said mechanism with an algorithm for adjusting said position of said adjustable stop relative to said moveable roll.

13. The process of claim 12 further comprising the step of said algorithm causing said controller to maintain a desired force between said fixed roll and said moveable roll based upon input provided by said force sensing device to said controller.

14. The process of claim 11 further comprising the step of controlling said apparatus with a programmable logic controller, said algorithm residing in said programmable logic controller.

15. The process of claim 14 further comprising the step of providing said algorithm as responsive to said force exerted by said moveable roll upon said adjustable stop.

16. The process of claim 10 further comprising the step of disposing an elastomeric cover about a surface of said moveable roll.

* * * * *

UNITED STATES PATENT AND TRADEMARK OFFICE

CERTIFICATE OF CORRECTION

PATENT NO. : 9,073,282 B2
APPLICATION NO. : 13/667032
DATED : July 7, 2015
INVENTOR(S) : George Vincent Wegele et al.

It is certified that error appears in the above-identified patent and that said Letters Patent is hereby corrected as shown below:

In the claims

Column 13, Line 44, Claim 4

Delete "fierce", insert --force--.

Signed and Sealed this
Fifteenth Day of December, 2015

Michelle K. Lee

Michelle K. Lee
*Director of the United States Patent and Trademark Office*